US009372422B2

(12) United States Patent
Zhou et al.

(10) Patent No.: US 9,372,422 B2
(45) Date of Patent: Jun. 21, 2016

(54) OPTIMIZED LATEX PARTICLE SIZE FOR IMPROVED HOT OFFSET TEMPERATURE FOR SUSTAINABLE TONERS

(71) Applicant: XEROX CORPORATION, Norwalk, CT (US)

(72) Inventors: Ke Zhou, Oakville (CA); Guerino G. Sacripante, Oakville (CA); Richard Philip Nelson Veregin, Mississauga (CA); Edward Graham Zwartz, Mississauga (CA); Abdisamed Sheik Qasim, Etobicoke (CA); Rashid Mahmood, Mississauga (CA); Mark R. Elliott, Burlington (CA); Cuong Vong, Hamilton (CA); Melanie Lynn Davis, Hamilton (CA)

(73) Assignee: XEROX CORPORATION, Norwalk, CT (US)

( * ) Notice: Subject to any disclaimer, the term of this patent is extended or adjusted under 35 U.S.C. 154(b) by 148 days.

(21) Appl. No.: 14/161,670

(22) Filed: Jan. 22, 2014

(65) Prior Publication Data

US 2015/0205219 A1 Jul. 23, 2015

(51) Int. Cl.
*G03G 9/087* (2006.01)
*G03G 9/08* (2006.01)

(52) U.S. Cl.
CPC ..... *G03G 9/0819* (2013.01); *G03G 9/0804* (2013.01); *G03G 9/0812* (2013.01); *G03G 9/08755* (2013.01); *G03G 9/08795* (2013.01); *G03G 9/08797* (2013.01)

(58) Field of Classification Search
CPC ..... G03G 9/0804; G03G 9/0812
USPC ..... 430/137.19, 137.14
See application file for complete search history.

(56) References Cited

U.S. PATENT DOCUMENTS

| | | | |
|---|---|---|---|
| 3,590,000 | A | 6/1971 | Palermiti et al. |
| 3,655,374 | A | 4/1972 | Palermiti et al. |
| 3,720,617 | A | 3/1973 | Chatterji et al. |
| 3,847,604 | A | 11/1974 | Hagenbach et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,298,672 | A | 11/1981 | Lu |
| 4,338,390 | A | 7/1982 | Lu |
| 4,394,430 | A | 7/1983 | Jadwin et al. |
| 4,560,635 | A | 12/1985 | Hoffend et al. |
| 4,935,326 | A | 6/1990 | Creatura et al. |
| 4,937,166 | A | 6/1990 | Creatura et al. |
| 5,290,654 | A | 3/1994 | Sacripante et al. |
| 5,302,486 | A | 4/1994 | Patel et al. |
| 6,004,714 | A | 12/1999 | Ciccarelli et al. |
| 6,190,815 | B1 | 2/2001 | Ciccarelli et al. |
| 7,736,831 | B2 | 6/2010 | Lai et al. |
| 8,192,913 | B2 | 6/2012 | Faucher et al. |
| 2010/0099037 | A1 * | 4/2010 | McAneney-Lannen et al. ..... G03G 9/0804 430/108.21 |
| 2013/0016466 | A1 | 1/2013 | Yen et al. |
| 2013/0196259 | A1 | 8/2013 | Iida et al. |

OTHER PUBLICATIONS

Weast, R.C., et al., ed., CRC Handbook of Chemistry and Physics, 48th edition, Chemical Rubber Co., OH (1967), pp. F-137 and F-138.*

* cited by examiner

*Primary Examiner* — Janis L Dote
(74) *Attorney, Agent, or Firm* — Shimokaji IP

(57) ABSTRACT

The disclosure provides sustainable toner particles of from about 180 nm to about 250 nm in a sustainable toner composition having a hot offset temperature of from about 190° C. to about 220° C.

5 Claims, No Drawings

OPTIMIZED LATEX PARTICLE SIZE FOR IMPROVED HOT OFFSET TEMPERATURE FOR SUSTAINABLE TONERS

TECHNICAL FIELD

This disclosure is generally directed to toner particles and methods for producing toner particles for use in forming and developing images of good quality. More specifically, this disclosure is directed to latex particles and improved processes for achieving a desired latex particle size after emulsification of a sustainable polymer, in order to achieve improved toner performance.

BACKGROUND

Numerous processes are known for the preparation of toners such as, for example, conventional processes wherein a polymer is melt kneaded or extruded with a pigment, micronized, and pulverized to provide toner particles. In addition, various emulsion technologies, including phase inversion emulsification (PIE) and emulsion/aggregation (EA) methods, may be used with a polyester type polymer to provide toner particles. PIE methods involve converting a dispersed polymer in a hydrophobic organic solvent from a water-in-oil (W/O) emulsion to an oil-in-water emulsion (O/W), whereby the polymer is dispersed as latex particles. EA methods involve heating a polymer in water to form an emulsion of latex particles. With either technique, a colorant or a pigment may be added to the latex mixture, followed by the addition of an aggregating agent or complexing agent to form aggregated latex particles. The aggregated latex particles may be heated to allow coalescence/fusing, thereby achieving spherical aggregated, fused toner particles.

The vast majority of polymeric materials used in toners are based on fossil fuels, leading ultimately to an increase in greenhouse gases and accumulation of non-degradable materials in the environment. Recently, the U.S. Department of Agriculture (USDA) has proposed that all toners/inks have a bio-based content of at least 20%. Renewable or biodegradable reagents and materials, such as those that are plant-based/animal-based or that are readily biodegradable, are being investigated as replacements for current toner reagents that may be produced in a simplified manner at a low cost.

There remains a need for improved bio-based toner compositions suitable for high speed printing, particularly high speed monochrome printing that provide excellent flow, charging, lower toner usage, and reduced drum contamination.

SUMMARY

The following detailed description is of the best currently contemplated mode of carrying out exemplary embodiments herein. The description is not to be taken in a limiting sense, but is made merely for the purpose of illustrating the general principles of the exemplary embodiments herein, since the scope of the disclosure is best defined by the appended claims.

Various inventive features are described below that can each be used independently of one another or in combination with other features.

Broadly, embodiments of the disclosure herein generally provide a sustainable toner composition which includes sustainable toner particles having a particle size of from about 180 nm to about 250 nm, wherein the toner composition has a hot offset temperature from about 190° C. to about 220° C.

In another aspect of the disclosure herein, a sustainable toner composition includes sustainable toner particles having a particle size of from about 180 nm to about 250 nm, wherein the toner composition has a fusing latitude of from about 70 to about 100.

In yet another aspect of the disclosure herein, a method for preparing a sustainable toner composition includes preparing sustainable toner particles in a solvent, wherein the particles have a size of from about 180 nm to about 250 nm; removing the solvents from the particles by distillation at a temperature from about 80° C. to about 90° C.; aggregating the particles to form aggregated particles; and coalescing the aggregated particles to produce the sustainable toner composition.

DETAILED DESCRIPTION

In the present disclosure, the term "bio-based" refers to a commercial or industrial product that is composed, in whole or in substantial part (e.g., at least about 50%, at least about 60%, at least about 70%, at least about 80%, at least 90% by weight), of biological products or renewable agricultural materials including plant, animal, and marine materials; forestry materials; or other naturally occurring source. A biodegradable reagent or product that is bio-based can be degraded by natural processes, for example, by a microorganism over a period of time comprising days, months or possibly a year or two. Some bio-based polymers that may be usable in toner compositions are commercially available while others may be prepared using methods known in the art.

In the present disclosure, the terms "sustainable" and "sustainability" and other grammatical variations thereof, refers to the amount, percentage, content or other measure of the components in a toner composition that is bio-based. For example, a sustainable polymer that comprises 75% of a bio-based reagent, such as a rosin, or a polyol, or a polyacid/polyester used to make the sustainable polymer, and which is obtained from a plant source, will have a sustainability content of 75%. Sustainable toner compositions of interest according to embodiments herein comprise at least about 50%, or at least about 60%, or at least about 70%, or at least about 80%, or at least about 90%, or at least about 95%, or more sustainable content. Generally, the calculation of the level of sustainability of a toner composition is made relative to the toner particle per se, without surface additives and without a carrier. Hence, in the context of an emulsion/aggregation toner, the calculation would be based on the toner particle following any aggregation and coalescence. A sustainable polymer, present in a sustainable toner particle of a sustainable toner composition, comprises at least about 50% sustainable content, or at least about 60%, or at least about 70%, or at least about 80%, or at least about 90%, or more sustainable content.

The fixing performance of a sustainable toner composition may be characterized as a function of temperature. The lowest temperature at which a sustainable toner adheres to the support medium is called the "cold offset temperature" (CO temperature).

The maximum temperature at which sustainable toner does not adhere to the fuser roll is called the "hot offset temperature" (HO temperature). When the fuser temperature exceeds the hot offset temperature, some of the molten sustainable toner adheres to the fuser roll during fixing and is transferred to subsequent substrates containing developed images, resulting for example in blurred images. This undesirable phenomenon is called "offsetting."

Between the cold offset temperature and hot offset temperature of the toner is the "minimum fix temperature"

(MFT), which is the minimum temperature at which acceptable adhesion of the sustainable toner to the support medium occurs, that is, as determined by for example a creasing test.

The temperature at which significant sintering or coalescing of the sustainable toner particles occurs when not in use is called the "blocking temperature." Sustainable toner compositions having high hot offset temperatures and high blocking temperatures are desired.

"Mottle" is the result of an uneven ink layer or non-uniform ink absorption across the paper surface, especially visible in mid-tone imagery or areas of uniform color such as solids and continuous-tone screen builds. This visible non-uniformity may be the result of differential ink gloss, density, or color of the printed ink film or it may be a variable function of randomly connected and disconnected mid-tone dots. In the present disclosure, the phrase "mottle temperature" refers to the temperature of the sustainable toner composition when mottle appears.

In the present disclosure "fusing latitude" refers to the ratio of (Mottle temperature−MFT)/(HO temperature−MFT) on a particular paper.

In the present disclosure, a "solvent ratio" refers to the amount of solvent to the amount of sustainable polymer, i.e., it is a measure of the concentration of the sustainable polymer components in a mixture.

In the present disclosure, a "neutralization ratio" refers to the amount of base required to neutralize a sustainable polymer's acidic groups. For example, a neutralization ratio of 1.0 or 100% implies that every acidic moiety in the sustainable polymer is neutralized by a base. A neutralization ratio of 110% implies that 10% additional base was utilized to neutralize 100% of the sustainable polymer based on the acid value. A neutralization ratio of 85% implies that 15% less base was utilized to neutralize 100% of the sustainable polymer based on the acid value.

In the present disclosure, "distillation" refers to a method of separating mixtures of components based on the differences in volatility of the components in a boiling liquid mixture. Distillation is a physical separation process and not a chemical reaction.

In the present disclosure, particle diameters at which a cumulative percentage of 50% of the total toner particles are attained are defined as volume or number D50, and the particle diameters at which a cumulative percentage of 84% are attained are defined as volume or number D84. The volume average particle size distribution, GSDv, and the number average particle size distribution, GSDn, can be expressed by using D50 and D84 in cumulative distribution, wherein the volume average particle size distribution index GSDv is expressed as (volume D84/volume D50) and the number average particle size distribution index GSDn is expressed as (number D84/number D50).

Sustainable Toner Particles

Sustainable toner particles according to embodiments herein can comprise a number of components including, for example, sustainable polymers such as those derived from one or more rosin acids. In addition, sustainable toner particles herein may include a number of optional components, including but not limited to colorants, pigments, surface additives, waxes and the like.

In various embodiments, the average sustainable toner particle size (measured in diameter) can be from about 180 nm to about 250 nm, or from about 190 nm to about 240 nm, or from about 200 nm to about 230 nm, Sustainable Toner Particles—Sustainable Polymer(s)

Sustainable toner particles can comprise one or more sustainable polymers, or more than one form or type of sustainable polymers, such as two or more different sustainable polymers composed of different monomers. The sustainable polymers can be an alternating copolymer, a block copolymer, a graft copolymer, a branched copolymer, a cross-linked copolymer and so on.

In some embodiments, where two or more sustainable polymers are used to form a sustainable toner particle, the sustainable polymers may be in any suitable ratio (e.g., weight ratio) such as, for instance, from about 1% (first sustainable polymer) and about 99% (second sustainable polymer), to about 99% (first sustainable polymer) and about 1% (second sustainable polymer); in other embodiments, from about 10% (first sustainable polymer) and about 90% (second sustainable polymer), to about 90% (first sustainable polymer) and about 10% (second sustainable polymer).

In some embodiments, the sustainable polymer(s) may be present in an amount from about 60% to about 95% by weight, or from about 70% to about 90% by weight, or from about 75% to about 85% by weight of the sustainable toner particle on a solids basis.

Suitable sustainable polymers herein may include, for example, sustainable polyester polymers, including sustainable polyester polymers derived from a rosin acid.

Sustainable Toner Particles—Rosin(s)

In some embodiments disclosed herein, the sustainable toner particles comprise rosin, a rosin derivative, or a mixture thereof. In the present disclosure, the terms "rosin" or "rosin derivative" are intended to encompass rosin, a rosin acid, a rosin ester and so on, as well as any other rosin derivatives. As known in the art, rosin is not a polymer but instead is a blend of at least eight monocarboxylic acids. Abietic acid is the primary species and the other seven acids are isomers thereof. Because of the composition of rosin, often the synonym "rosin acid" is used to describe various rosin derived products. A rosin derivative includes, as known in the art, chemically modified rosin, such as, partially or fully hydrogenated rosin acids, partially or fully dimerized rosin acids, esterified rosin acids, functionalized rosin acids and combinations thereof. Rosin is available commercially in a number of forms, for example, as rosin acid, as a rosin ester and so on.

Sustainable Toner Particles—Preparation

The preparation of sustainable toner compositions and sustainable toner particles comprising a sustainable polymer derived from a bio-based rosin acid, a cyclic alkylene carbonate, an aromatic carboxylic acid and polyol, and comprising an optional wax and an optional colorant is described in U.S. Patent Application Publication No. 20130164668 A1, the disclosure of which is hereby incorporated by reference in its entirety.

In embodiments of the present disclosure, rosin acids are converted into difunctional monomers, such as rosin monoglycerates or rosin diols, by reacting the rosin acid, such as abietic acid, with a glycerine carbonate and a catalyst, such as triethyl ammonium iodide and the like as known to those of skill in the art, resulting in an abietic monogylcerate or an abietic diol. Examples of the glycerine carbonates, selected for the reaction with the rosin acids, include but are not limited to glycerine carbonate, glycerol carbonate, glyceryl carbonate, and 4-hydroxymethyl-1,3-dioxolan-2-one. The catalyst may be selected in amounts of, for example, from about 0.01 mole % to about 5 mole %, from about 0.1 to about 0.8 mole %, from about 0.2 to about 0.6 mole %, based on the starting diacid or diester used to generate the sustainable polymers.

In certain embodiments, a process of the present disclosure for preparing sustainable toner particles comprises the reaction of a rosin acid (e.g., a disproportionate rosin acid), inclusive of known rosin acids as disclosed herein, with a non-toxic, economical, bio-based glycerine carbonate, and which reaction is accomplished in the presence of an optional polycondensation catalyst. The reaction may be seen in the schematic below:

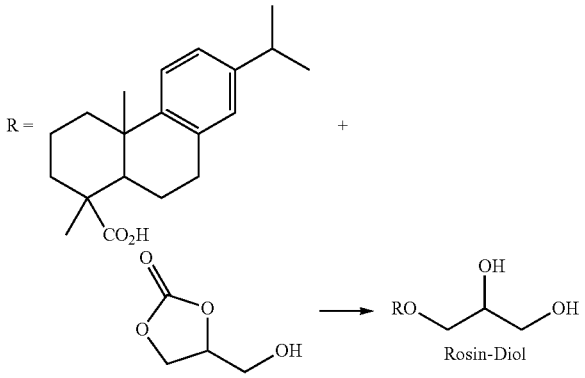

The corresponding rosin-diol may then polymerize with monomers comprising a carboxylic acid (e.g., terephthalic acid) and a polyol (e.g., butyl ethylene glycol) to achieve the bio-based sustainable polymer. In some embodiments, the corresponding rosin-diol is polymerized with the monomers, terephthalic acid and butyl ethylene glycol (2-butyl-2-ethyl-1,3-propanediol) as seen in the schematic below.

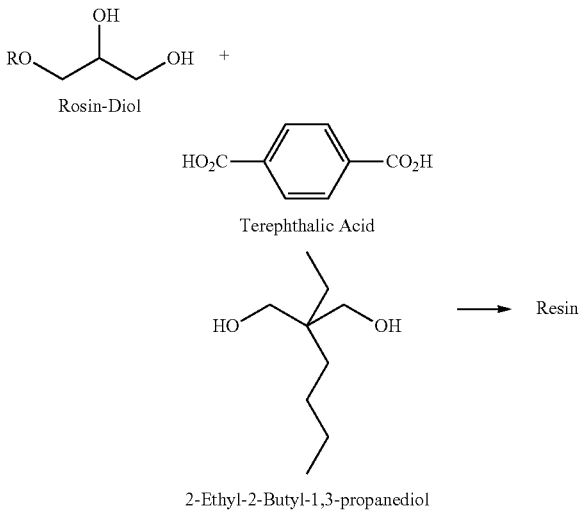

In some embodiments of the processes, there is prepared a rosin diol by the reaction of the components of a rosin acid, a bio-based glycerin carbonate, and an optional catalyst, which components are heated at various temperatures, such as for example, from about 110° C. to about 190° C., from about 120° C. to about 185° C., from about 120° C. to about 160° C., for a period of, for example, from about 1 hr to about 10 hr, from about 1 hr to about 9 hr, such that the resulting product has an acid value of equal to or less than about 1 mg KOH/gram (>99% yield), from about 0.1 to about 1, from 1 to about 1.9, from about 1 to about 1.5 mg KOH/gram, or 0 mg KOH/gram (100% yield).

Processes for the preparation of rosin diols can be accomplished by charging a reaction vessel with from about 0.95 to about 1.05 mole equivalent of rosin acid, from about 1.10 to 2.2 mole equivalents of glycerine carbonate, from about 0.001 to about 0.01 mole equivalent of a catalyst, such as tetraethyl or tetrabutyl ammonium iodide. The resulting mixture then is heated with stirring to a temperature from about 120° C. to about 185° C. for a period from about 1 hr to about 9 hr. The reaction is monitored until the acid value of the reaction mixture is less than about 1 mg KOH/grams, such as, from about 1 to about zero. Although a slight excess from about 0.05 to about 0.15 mole equivalent of glycerine carbonate can be selected for the reaction, a larger excess from about 0.16 to about 2 mole equivalents of glycerine carbonate can be utilized. The excess glycerin carbonate can serve as a branching agent during the polymerization with the diacid to produce the amorphous bio-based sustainable polymers.

In some instances, a minor amount of a product, such as a bis-rosin glycerate, forms from the reactions disclosed herein, especially in some instances when basic catalysts are utilized. For example, when there is selected a catalyst of 2-methyl imidazole or dimethyl amino pyridine, a bis-rosin glycerate may result as the major product. The formation of the disclosed bis-rosin glycerate is not necessarily avoided as it can also polymerize through trans-esterification reactions with a diacid and a diol in the presence of a polycondensation catalyst at temperatures from about 220° C. to about 260° C., to result in the bio-based amorphous sustainable polymer. Furthermore, when an excess amount of glycerine carbonate is selected, it can subsequently react with the diacid/diol to form the bio-based amorphous sustainable polymer, and where the excess glycerol and/or glycerine content are a source of branching.

Subsequently, the prepared rosin diols from about 0.1 to about 0.4 mole %, are reacted with a diol, such as, 2-ethyl-2-butyl-1,3-propanediol, from about 0.1 to about 0.3 mole, and a suitable acid, such as a terephthalic acid, from about 0.48 to about 0.52 mole % to generate the desired bio-based amorphous sustainable polymers. The bio-based amorphous sustainable polymers generated from glycerine carbonate monomers, which monomers are considered bio-based because they are derived from natural sources of, for example, rosins obtained from tree sap and glycerine obtained mostly from vegetable oils and suitable petrochemicals such as those derived from isophthalic acid, terephthalic acid, and the like.

The rosin diols resulting in accordance with the processes disclosed herein are reacted with a number of known diacids, such as dicarboxylic acids, as represented by the following formulas/structures, HOOC—R—COOH, where R is aryl or comprises an aryl group or heteroaryl group. Specific examples of dicarboxylic acids that can be reacted with the rosin diols and organic diols are folic acid, isophthalic acid, phthalic acid, terephthalic acid, and the like. The diacid is selected in an amount of, for example, from about 40 to about 60 mole %, from about 45 to about 55 mole % of the sustainable polymer solids.

Specific examples of optional organic diols that can be reacted with the rosin diols and diacids are alkylene glycols like ethylene glycol, 1,2-propylene glycol, 1,3-propane diol, butylene glycol, ethyl butylene glycol, pentylene glycol, 1,6-hexane diol, 2-ethyl-2-butyl-1,3-propanediol, 1,7-heptanediol, 1,9-nonanediol, 1,10-decanediol, or 1,4-cyclohexane diol; 1,4-cyclohexanedimethanol, and mixtures thereof. The diols are, for example, selected in an amount from about 0 to about 25, from about 5 to about 15 mole % of the sustainable polymer solids.

Toner Particles—Branching Agent(s)

Branching agents, such as multivalent polyacid or polyol, can also be utilized in preparing the sustainable polymers for the sustainable toner particles in order to crosslink or to obtain the branched amorphous bio-based sustainable polymers. Examples of branching agents, include, for example a multivalent polyacid such as 1,2,4-benzene-tricarboxylic acid; 1,2,4-cyclo-hexanetricarboxylic acid; 2,5,7-naphthalenetricarboxylic acid; 1,2,4-naphthalene-tricarboxylic acid; 1,2,5-hexanetricarboxylic acid; 1,3-dicarboxyl-2-methyl-2-methyl-ene-carboxyl-propane; tetra(methylene-carboxyl) methane; and 1,2,7,8-octane-tetra-carboxylic acid; acid anhydrides thereof, and lower, with from 1 to about 6 carbon atoms; alkyl esters; multivalent polyols such as sorbitol; 1,2,3,6-hexanetetrol; 1,4-sorbitane; pentaerythritol; dipentaerythritol; tripentaerythritol; sucrose; 1,2,4-butanetriol; 1,2,5-pentatriol; glycerol; glycerine carbonate; 2-methylpropanetriol; 2-methyl-1,2,4-butanetriol; trimethylolethane; trimethylolpropane; 1,3,5-trihydroxy-methylbenzene; mixtures thereof; and the like.

The branching agent can be present in an amount of, for example, from about 0.01 to about 10 mole % of the sustainable polymer, or from about 0.05 to about 8 mole % of the sustainable polymer, or from about 0.1 to about 5 mole % of the sustainable polymer.

The linear and branched amorphous sustainable polymers, in some embodiments, possess, for example, a number average molecular weight ($M_n$), as measured by gel permeation chromatography (GPC) of from about 10,000 to about 500,000, or from about 5,000 to about 250,000; and a weight average molecular weight ($M_w$) of, for example, from about 20,000 to about 600,000, or from about 7,000 to about 300,000, as determined by GPC; and a molecular weight distribution ($M_w/M_n$) of, for example, from about 1.5 to about 6, or from about 2 to about 4.

Sustainable Toner Particles—Other Polyester Resin(s)

Other suitable polyester polymers that may be added to the sustainable toner particles herein, include, for example, those polymers which are non-sulfonated, crystalline, amorphous, and combinations thereof, as described in U.S. Patent Application Publication No. 20130164668 A1.

Sustainable Toner Particles—Colorants/Pigments

Suitable colorants can be added to the sustainable toner particles described herein, and include those colorants comprising carbon black, such as, REGAL 330® and Nipex 35; magnetites, such as, Mobay magnetites, MO8029™ and MO8060™; Columbian magnetites, such as, MAPICO® BLACK; surface-treated magnetites; Pfizer magnetites, such as, CB4799™, CB5300™, CB5600™ and MCX6369™; Bayer magnetites, such as, BAYFERROX 8600™ and 8610™; Northern Pigments magnetites, such as, NP604™ and NP608™; Magnox magnetites, such as, TMB-100™ or TMB104™; and the like.

Colored pigments, such as cyan, magenta, orange, violet, brown, blue or mixtures thereof can be also be used, where the colored pigments exhibit a spectral response reflectance of R=0.20 or lower over the full spectral range, from about 400 to about 700 nm. The additional pigment or pigments may be used as water-based pigment dispersions.

Examples of suitable pigments include SUNSPERSE 6000, FLEXIVERSE and AQUATONE, water-based pigment dispersions from SUN Chemicals; HELIOGEN BLUE L6900™, D6840™, D7080™, D7020™, PYLAM OIL BLUE™, and PIGMENT BLUE I™ available from Paul Uhlich & Company, Inc.; PIGMENT VIOLET I™ available from Dominion Color Corporation, Ltd.; and the like.

Other known colorants may be used, such as, Levanyl Black ASF (Miles, Bayer) and Sunsperse Carbon Black LHD 9303 (Sun Chemicals); and colored dyes, such as, Neopen Blue (BASF), Sudan Blue OS (BASF), PV Fast Blue B2G 01 (American Hoechst), Sunsperse Blue BHD 6000 (Sun Chemicals), Irgalite Blue BCA (CibaGeigy), Paliogen Blue 6470 (BASF), Sudan Orange G (Aldrich), Sudan Orange 220 (BASF), Paliogen Orange 3040 (BASF), Ortho Orange OR 2673 (Paul Uhlich); combinations of the foregoing; and the like.

The colorant, when present, may be employed in an amount greater than 6%, such as, ranging from about 7% to about 17% by weight, or from about 8% to about 15% by weight, or from about 9% to about 13% by weight of the sustainable toner particles on a solids basis.

In some embodiments, portions of the pigment loading, for example furnace carbon black (e.g., Nipex 35), may be replaced by two or more second colorants or pigments that are not blacks. In certain embodiments, the pigment loading is increased by at least about 10%, or by at least about 20%, or by at least about 30% or more by replacing portions of the black with a set of color pigments that exhibit a spectral response that is substantially the same as carbon black and where such color pigments may be selected based on spectral response curve data.

In some embodiments, more than two colorants may be present in a sustainable toner particle. For example, three colorants may be present in a sustainable toner particle, such as, a first colorant of pigment, may be present in an amount ranging from about 1% to about 10% by weight, or from about 2% to about 8% by weight, or from about 3% to about 4.2% by weight of the sustainable toner particle on a solids basis; with a second colorant of pigment that may be present in an amount ranging of from about 1% to about 10% by weight, or from about 2% to about 8% by weight, or from about 3% to about 4.5% by weight of the sustainable toner particle on a solids basis; with a third colorant of pigment that may be present in an amount ranging of from about 0% to about 0.81% by weight, or from about 0.1% to about 1.0% by weight, or from about 0.5% to about 0.7% by weight of the sustainable toner particle on a solids basis.

Sustainable Toner Particles—Surface Additive(s)

In some embodiments, the sustainable toner particles may be mixed with one or more surface additives, such as silicon dioxide or silica ($SiO_2$), titania or titanium dioxide ($TiO_2$), and/or cerium oxide. These additives may enhance sustainable toner flow, tribo control, admix control, improved development and transfer stability, and higher sustainable toner blocking temperature. The surface additive(s) may be used with or without a coating or shell.

In some embodiments, silica may be a first silica and a second silica. The first silica may have an average primary particle size, measured in diameter, in the range of, for example, from about 5 nm to about 50 nm, or from about 5 nm to about 25 nm, or from about 20 nm to about 40 nm. The second silica may have an average primary particle size, measured in diameter, in the range of, for example, from about 100 nm to about 200 nm, or from about 100 nm to about 150 nm, or from about 125 nm to about 145 nm. The second silica may have a larger average size (diameter) than the first silica.

Titania may have an average primary particle size in the range of, for example, about 5 nm to about 50 nm, or from about 5 nm to about 20 nm, or from about 10 nm to about 50 nm.

Cerium oxide may have an average primary particle size in the range of, for example, from about 5 nm to about 50 nm, or from about 5 nm to about 20 nm, or from about 10 nm to about 50 nm.

Zinc stearate also may be used as an additive. Calcium stearate and magnesium stearate may provide similar functions. Zinc, calcium or magnesium stearate may also provide developer conductivity, tribo enhancement, higher sustainable toner charge, and charge stability. Zinc stearate may have an average primary particle size in the range of, for example, from about 500 nm to about 700 nm, or from about 500 nm to about 600 nm, or from about 550 nm to about 650 nm.

Surface additives may be used in an amount of from about 0.1 to about 10 weight %, or from about 0.5 to about 7 weight %, or from about 1% to about 5 weight % of the sustainable toner particle.

Other examples of surface additives include those disclosed in U.S. Pat. Nos. 3,590,000; 3,720,617; 3,655,374; and 3,983,045, the disclosures of which are hereby incorporated by reference in their entireties.

Other surface additives include lubricants, such as, a metal salt of a fatty acid (e.g., calcium stearate) or long chain alcohols, such as, UNILIN 700 available from Baker Petrolite and AEROSIL R972® available from Degussa. The coated silicas of U.S. Pat. Nos. 6,190,815 and 6,004,714 may also be useful, the disclosures of which are hereby incorporated by reference in their entireties.

Sustainable Toner Particles—Catalyst(s)

The gloss of a sustainable toner may be influenced by the amount of retained metal ion, such as, $Al^{3+}$, in a particle. The amount of retained metal ion may be adjusted further by the addition of a chelator, such as, EDTA. In some embodiments, the amount of retained catalyst, for example, $Al^{3+}$, in sustainable toner particles of the present disclosure may be of from about 0.1 pph to about 1 pph, or from about 0.25 pph to about 0.8 pph. The gloss level of a sustainable toner of the instant disclosure may have a gloss, as measured by Gardner gloss units (gu), of from about 20 gu to about 100 gu, or from about 50 gu to about 95 gu, or from about 60 gu to about 90 gu.

Processes for Preparing Sustainable Toner Particles

Emulsification

The sustainable toner particles herein may be prepared by any method within the purview of one skilled in the art; for example, any of the phase inversion emulsification (PIE) or emulsion/aggregation (EA) methods may be used with a sustainable polymer and the optional components taught herein.

The PIE method is a method in which a sustainable polymer to be dispersed is dissolved in a hydrophobic organic solvent that is able to dissolve the sustainable polymer, a base is then added thereto in an organic continuous phase (O phase) to neutralize the solution, and then an aqueous medium (W phase) is added to the resultant. In this manner, the sustainable polymer is converted from W/O to O/W (so-called phase inversion) and becomes a discontinuous phase, whereby the sustainable polymer is dispersed in the shape of particles (see, e.g., U.S. Pub. No. 2013/0196259, the disclosure of which is hereby incorporated by reference in its entirety).

Other suitable methods of preparing sustainable toner particles may be used, including chemical processes, such as, suspension and encapsulation processes disclosed, for example, in U.S. Pat. Nos. 5,290,654 and 5,302,486, the disclosures of which are hereby incorporated by reference in their entireties; by conventional granulation methods, such as, jet milling; pelletizing slabs of material; other mechanical processes; any process for producing nanoparticles or microparticles; and so on.

In some embodiments relating to an emulsification/aggregation process, one or more sustainable polymers, one or more of which is a sustainable polymer, such as one comprising a bio-based polyester/polyacid of interest, for example a rosin based sustainable polymer, may be dissolved in a solvent; and may be mixed into an emulsion medium, for example, water, such as, deionized water; optionally containing a stabilizer; and optionally containing a surfactant.

Examples of suitable stabilizers include water-soluble alkali metal hydroxides, such as, sodium hydroxide, potassium hydroxide, lithium hydroxide, beryllium hydroxide, magnesium hydroxide, calcium hydroxide or barium hydroxide; ammonium hydroxide; alkali metal carbonates, such as, sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. When a stabilizer(s) is used, the stabilizer may be present in an amount of from about 0.1% to about 5%, or from about 0.5% to about 3% by weight, or from about 1% to about 2% by weight of the sustainable polymer.

Optionally, a surfactant may be added to the aqueous emulsion medium, for example, to afford additional stabilization to the sustainable polymer or to enhance emulsification of the sustainable polymer. Suitable surfactants include anionic, cationic and nonionic surfactants as taught herein. When a surfactant(s) is used, the surfactant(s) may be present in an amount of from about 0.1% to about 20%, or from about 1% to about 10% by weight, or from about 2% to about 5% by weight of the sustainable polymer.

The addition of a surfactant to the aqueous emulsion medium may change the solvent ratio of the amount of solvent to the amount of the sustainable polymer present in the emulsion. In some embodiments additional sustainable polymer may be added to the emulsion in order to maintain the same solvent ratio.

Additional sustainable polymer may also be added when a surfactant(s) is used, for example, when the surfactant(s) is present in an amount of from about 0.1% to about 20%, or from about 1% to about 10% by weight, or from about 2% to about 5% by weight of the sustainable polymer.

After emulsification and latex particle formation, the emulsion may be neutralized by the addition of one or more bases. In some embodiments the neutralization ratio may be from about 70% to about 80%, or from about 80% to about 90%, or from about 90% to about 100%.

The solvents (for example, methyl ethyl ketone (MEK) and isopropanol) used in an emulsification mixture may be present in a solvent ratio from about 20 to about 1, or from about 15 to about 1, or from about 10 to about 1.

The solvents (for example, methyl ethyl ketone (MEK) and isopropanol) used in an emulsification mixture may be removed from the particles such as by distillation. In some embodiments, the distillation occurs at a temperature of from about 80° C. to about 90° C., or from about 82° C. to about 88° C., or from about 84° C. to about 86° C., and at a pressure of from about 750 mm Hg to about 760 mm Hg, or from about 755 mm Hg to about 765 mm Hg, or from about 760 mm Hg to about 765 mm Hg.

Following emulsification, a sustainable toner composition may be prepared by aggregating a mixture of sustainable toner particles and then optionally coalescing the aggregate mixture. A mixture may be prepared by adding an optional wax or other materials, which may also be optionally in a dispersion, including a surfactant, to the sustainable toner particle emulsion. The pH of the resulting mixture may be adjusted with an acid, such as, for example, acetic acid, nitric acid or the like. In some embodiments, the pH of the mixture may be adjusted to from about 2 to about 4.5, or from about 2.5 to about 4, or from about 3 to about 3.5.

Additionally, in some embodiments, the mixture may be homogenized. If the mixture is homogenized, mixing may be at from about 600 to about 4,000 rpm. Homogenization may be by any suitable means, including, for example, an IKA ULTRA TURRAX T50 probe homogenizer.

Aggregation

Following preparation of the above sustainable toner particle mixture, it can be desirable to form larger particles or aggregates, often sized in micrometers, of the smaller particles from the initial polymerization reaction, often sized in nanometers. An aggregating factor may be added to the mixture. Suitable aggregating factors include, for example, aqueous solutions of a divalent cation, a multivalent cation or a compound comprising same. In some embodiments, the aggregating factor can be an inorganic cationic coagulant, such as, for example, polyaluminum chloride (PAC), polyaluminum sulfosilicate (PASS), aluminum sulfate, zinc sulfate, magnesium sulfate, chlorides of magnesium, calcium, zinc, beryllium, aluminum, sodium, and other metal halides including monovalent and divalent halides. The aggregating factor may be present in an emulsion in an amount of from about 0.01 to about 10 weight %, or from about 0.05 to about 5 weight %, or from about 0.1% to about 3% based on the total solids in the sustainable toner particle. The aggregating factor may also contain minor amounts of other components, for example, nitric acid.

The aggregating factor may be added to the mixture at a temperature that is below the glass transition temperature ($T_g$) of the sustainable polymer. The aggregating factor may be added to the mixture components to form a sustainable toner in an amount of, for example, from about 0.1 pph to about 1 pph, or from about 0.25 pph to about 0.75 pph, or about 0.5 pph of the reaction mixture.

To control aggregation of the sustainable toner particles, the aggregating factor may be metered into the mixture over time. For example, the factor may be added incrementally into the mixture over a period of from about 5 to about 240 minutes, or from about 30 to about 200 minutes. Addition of the aggregating factor also may be done while the mixture is maintained under stirred conditions, in some embodiments, of from about 50 rpm to about 1,000 rpm, or from about 100 rpm to about 500 rpm; and at a temperature that is below the $T_g$ of the sustainable polymer, for example, of from about 30° C. to about 90° C., or from about 35° C. to about 70° C. The growth and shaping of the sustainable toner particles following addition of the aggregation factor may be accomplished under any suitable condition(s).

The sustainable toner particles may be permitted to aggregate until a predetermined desired particle size is obtained. Particle size may be monitored during the growth process. For example, samples may be taken during the growth process and analyzed, for example, with a COULTER COUNTER, for average particle size. The aggregation thus may proceed by maintaining the mixture, for example, at elevated temperature, or slowly raising the temperature, for example, of from about 40° C. to about 100° C. or from about 50° C. to about 90° C., and holding the mixture at that temperature for example, of from about 0.5 hours to about 6 hours, or from about hour 1 to about 5 hours, while maintaining stirring, to provide the desired aggregated sustainable toner particles. Once the predetermined desired sustainable toner particle size is attained, the growth process is halted.

Once the desired final size of the sustainable toner particles or aggregates is achieved, the pH of the mixture may be adjusted with base to a value of from about 6 to about 10, or from about 6.2 to about 7. The adjustment of pH may be used to freeze, that is, to stop, sustainable toner particle growth. The base used to stop sustainable toner particle growth may be, for example, an alkali metal hydroxide, such as, for example, sodium hydroxide, potassium hydroxide, ammonium hydroxide, combinations thereof and the like. In some embodiments, EDTA may be added to assist adjusting the pH to the desired value. The base may be added in amounts of from about 2 to about 25% by weight or from about 4 to about 10% by weight of the mixture.

In some embodiments, a sequestering agent or chelating agent may be introduced during or after aggregation is complete to adjust pH and/or to sequester or to extract a metal complexing ion, such as, aluminum, from the aggregation process. Thus, the sequestering, chelating or complexing agent used after aggregation is complete may comprise a complexing component, such as, ethylenediaminetetraacetic acid (EDTA), gluconal, hydroxyl-2,2'iminodisuccinic acid (HIDS), dicarboxylmethyl glutamic acid (GLDA), methyl glycidyl diacetic acid (MGDA), hydroxy-diethyliminodiacetic acid (HIDA), sodium gluconate, potassium citrate, sodium citrate, nitrotriacetate salt, humic acid, fulvic acid; salts of EDTA, such as, alkali metal salts of EDTA, tartaric acid, gluconic acid, oxalic acid, polyacrylates, sugar acrylates, citric acid, polyasparic acid, diethylenetriamine pentaacetate, 3-hydroxy-4-pyridinone, dopamine, eucalyptus, iminodisuccinic acid, ethylenediamine-disuccinate, polysaccharide, sodium ethylenedinitrilotetraacetate, thiamine pyrophosphate, farnesyl pyrophosphate, 2-aminoethylpyrophosphate, hydroxyl ethylidene-1,1-diphosphonic acid, aminotrimethylenephosphonic acid, diethylene triaminepentamethylene phosphonic acid, ethylenediamine tetramethylene phosphonic acid, and mixtures thereof.

For separate aggregation and coalescence stages, the aggregation process may be conducted under shearing conditions at an elevated temperature, for example, of from about 40° C. to about 90° C., or from about 45° C. to about 80° C., which may be below the $T_g$ of the sustainable polymer.

In some embodiments, the aggregate sustainable toner particles may be of a size of less than about 3 μm, or from about 2 μm to about 6 μm, or from about 3 μm to about 5 μm.

Shell Covering

In some embodiments, after aggregation, but prior to coalescence, a polymer coating may be applied to the aggregated sustainable toner particles to form a shell thereover. Any sustainable polymer described herein or as known in the art may be used as the shell. In some embodiments, an amorphous sustainable polymer as described herein, such as one comprising a bio-based rosin and/or polyester/polyacid may be included in the shell. In some embodiments, an amorphous sustainable polymer described herein, such as one comprising a bio-based rosin and/or polyacid/polyester may be combined with a different polymer, and then added to the particles as a sustainable polymer coating to form a shell.

A shell polymer may be applied to the aggregated sustainable toner particles by any method within the purview of those skilled in the art. In some embodiments, the polymer used to form the shell may be in an emulsion, optionally including any surfactant described herein. The emulsion possessing the sustainable polymer may be combined with the aggregated sustainable toner particles so that the shell forms over the aggregated particles. The formation of the shell over the aggregated sustainable particles may occur while heating to a temperature of from about 30° C. to about 80° C., or from about 35° C. to about 70° C., or from about 40° C. to about 60° C. The formation of the shell may take place for a period of time from about 5 minutes to about 10 hours, or from about 10 minutes to about 5 hours. The shell may be present in an amount of from about 1% by weight to about 80% by weight, or from about 10% by weight to about 40% by weight, or from about 20% by weight to about 35% by weight of the sustainable toner components.

Coalescence

Following aggregation to a desired particle size and application of any optional shell, the sustainable toner particles may be coalesced to a desired final shape, such as, for example, a circular shape, to correct for irregularities in the shape and size. The coalescence can be achieved by, for example, heating the aggregated sustainable toner particles to a temperature of from about 45° C. to about 100° C., or from about 55° C. to about 99° C., which may be at or above the $T_g$ of the sustainable polymer used to form the sustainable toner particles, and/or reducing the stirring, for example to from about 1000 rpm to about 100 rpm, or from about 800 rpm to about 200 rpm. In some embodiments, the coalescence temperature is about 75° C. Coalescence may be conducted over a period from about 0.01 to about 9 hours, or from about 0.1 to about 4 hours; see, for example, U.S. Pat. No. 7,736,831, the disclosure of which is hereby incorporated by reference in its entirety. In some embodiments, coalescence is conducted over a period from 1 to about 3 hours.

Optionally, a coalescing agent(s) may be used. Examples of suitable coalescing agents include, but are not limited to, benzoic acid alkyl esters, ester alcohols, glycol/ether-type solvents, long chain aliphatic alcohols, aromatic alcohols, mixtures thereof and the like. Examples of benzoic acid alkyl esters include those where the alkyl group, which may be straight or branched, substituted or unsubstituted, has from about 2 to about 30 carbon atoms, such as decyl or isodecyl benzoate, nonyl or isononyl benzoate, octyl or isooctyl benzoate, 2-ethylhexyl benzoate, tridecyl or isotridecyl benzoate, 3,7dimethyloctyl benzoate, 3,5,5-trimethylhexyl benzoate, mixtures thereof and the like. In some embodiments, the coalescence agent (or coalescing agent or coalescence aid agent) evaporates during later stages of the emulsion/aggregation process, such as during a second heating step that is generally above the $T_g$ of the sustainable polymer. The final sustainable toner particles are thus free of, or essentially or substantially free of, any remaining coalescing agent. To the extent that any remaining coalescing agent may be present in a final sustainable toner particle, the amount of remaining coalescing agent is such that presence thereof does not affect any properties or the performance of the sustainable toner or developer.

The coalescing agent can be added prior to the coalescence or fusing step in any desired or suitable amount. For example, the coalescing agent may be added in an amount from about 0.01 to about 10% by weight, based on the solids content in the reaction medium. Of course, amounts outside those ranges can be used, as desired. In some embodiments, the coalescing agent can be added at any time between aggregation and coalescence, although in some embodiments it may be desirable to add the coalescing agent after aggregation is, "frozen," or completed, for example, by adjustment of pH, for example, by addition, for example, of base. Coalescence may proceed and be accomplished over a period of from about 0.1 to about 9 hours, or from about 1 to about 3 hours, or from about 1.3 to about 2.0 hours. After coalescence, the mixture may be cooled to room temperature, such as, from about 20° C. to about 25° C. The cooling may be rapid or slow as desired. A suitable cooling method may include introducing cold water in a jacket around the reactor. After cooling, the sustainable toner particles optionally may be washed with water and then dried. Drying may be accomplished by any suitable method for drying including, for example, freeze drying.

Sustainable Toner Particles—Surface Modification(s)

The sustainable toner particles can have various surface modifications to obtain desired properties. The dry sustainable toner particles, exclusive of surface additives, may have the following characteristics: (1) volume average diameter (also referred to as "volume average particle diameter") of from about 2.5 to about 20 μm, or from about 2.75 to about 10 μm, or from about 3 to about 7.5 μm; (2) number average geometric standard deviation (GSDn) and/or volume average geometric standard deviation (GSDv) of from about 1.18 to about 1.30, or from about 1.21 to about 1.24, or from about 1.22 to about 1.23; and (3) circularity (measured with, for example, a Sysmex FPIA 2100 analyzer) of from about 0.9 to about 1.0, or from about 0.95 to about 0.985, or from about 0.96 to about 0.98, or from about 0.950 to about 0.970, or about 0.698.

Sustainable Toner Compositions—Developer(s)

The sustainable toner particles thus formed may be formulated into a developer composition. For example, the sustainable toner particles may be mixed with carrier particles to achieve a two component developer composition. The sustainable toner particle concentration in the developer may be from about 1% to about 25% by weight, or from about 2% to about 15% by weight of the total weight of the developer, with the remainder of the developer composition being the carrier. However, different sustainable toner particles and carrier percentages may be used to achieve a developer composition with desired characteristics.

Sustainable Toner Compositions—Carrier(s)

A sustainable toner composition optionally can comprise inert particles, which can serve as sustainable toner particle carriers. The inert particles can be modified, for example, to serve a particular function. Hence, the surface thereof can be derivatized or the sustainable toner particles can be manufactured for a desired purpose, for example, to carry a charge or to possess a magnetic field. Examples of carrier particles for mixing with the sustainable toner particles include those carrier particles that are capable of triboelectrically obtaining a charge of polarity opposite to that of the sustainable toner particles. Illustrative examples of suitable carrier particles include granular zircon, granular silicon, glass, steel, nickel, ferrites, iron ferrites, silicon dioxide, one or more polymers and the like. Other carriers include those disclosed in U.S. Pat. Nos. 3,847,604; 4,937,166; and 4,935,326, the disclosures of which are hereby incorporated by reference in their entireties.

In some embodiments, the carrier particles may include a core with a coating thereover, which may be formed from a polymer or a mixture of polymers that are not in close proximity thereto in the triboelectric series, such as, those as taught herein or as known in the art. The coating may include fluoropolymers, such as polyvinylidene fluorides, terpolymers of styrene, methyl methacrylates, silanes, such as triethoxy silanes, tetrafluoroethylenes, other known coatings and the like. For example, coatings containing polyvinylidene fluoride, available, for example, as KYNAR 301F™, and/or polymethylmethacrylate (PMMA), for example, having a weight average molecular weight of about 300,000 to about 350,000, such as, commercially available from Soken, may be used. In some embodiments, PMMA and polyvinylidenefluoride may be mixed in proportions from about 30 to about 70 weight % to about 70 to about 30 weight %, or from about 40 to about 60 weight % to about 60 to about 40 weight %. The coating may have a coating weight of, for example, from about 0.1 to about 5% by weight, or from about 0.5 to about 2% by weight of the carrier. The carrier particles may be prepared by mixing the carrier core with a polymer in an amount of from about 0.05% to about 10% by weight, or from about 0.01% to about 3% by weight, based on the weight of the coated carrier particle, until adherence thereof to the carrier core is obtained, for example, by mechanical impaction and/or electrostatic attraction.

Sustainable Toner Compositions—Surfactant(s)

The sustainable toner compositions may be in dispersions including surfactants. The surfactants may be selected from ionic surfactants and nonionic surfactants, or combinations thereof. Anionic surfactants and cationic surfactants are encompassed by the term, "ionic surfactants." The surfactant or the total amount of surfactants in a sustainable toner composition may be used in an amount of from about 0.01% to about 5%, or from about 0.05% to about 3%, or from about 0.1% to about 2% by weight of the sustainable toner composition.

Examples of nonionic surfactants include, for example, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether and dialkylphenoxy poly(ethyleneoxy) ethanol, for example, available from Rhone-Poulenc as IGEPAL CA-210™, IGEPAL CA520™, IGEPAL CA-720™, IGEPAL CO-890™, IGEPAL CO-720™, IGEPAL CO-290™, IGEPAL CA-210™, ANTAROX 890™ and ANTAROX 897™.

Other examples of suitable nonionic surfactants include a block copolymer of polyethylene oxide and polypropylene oxide, including those commercially available as SYNPERONIC® PR/F and SYNPERONIC® PR/F 108; and DOWFAX, available from The Dow Chemical Corp.

Examples of anionic surfactants include sulfates and sulfonates, such as, sodium dodecylsulfate (SDS), sodium dodecylbenzene sulfonate, sodium dodecylnaphthalene sulfate and so on; dialkyl benzenealkyl sulfates; acids, such as, palmitic acid, and NEOGEN or NEOGEN SC obtained from Daiichi Kogyo Seiyaku, and so on, combinations thereof and the like. Other suitable anionic surfactants include, in some embodiments, alkyldiphenyloxide disulfonates or TAYCA POWER BN2060 from Tayca Corporation (Japan), which is a branched sodium dodecyl benzene sulfonate. Combinations of those surfactants and any of the foregoing nonionic surfactants may be used in some embodiments.

Examples of cationic surfactants include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, trimethyl ammonium bromides, halide salts of quarternized polyoxyethylalkyl-amines, dodecylbenzyl triethyl ammonium chlorides, MIRAPOL® and ALKAQUAT® available from Alkaril Chemical Company, SANISOL® (benzalkonium chloride) available from Kao Chemicals and the like, and mixtures thereof, including, for example, a nonionic surfactant as known in the art or provided hereinabove.

Sustainable Toner Compositions—Wax(es)

The sustainable toner compositions of the instant disclosure, optionally, may contain a wax, which can be either a single type of wax or a mixture of two or more different types of waxes (hereinafter identified as, "a wax"). A wax can also be added to a sustainable toner formulation or to a developer formulation, for example, to improve particular sustainable toner properties, such as, sustainable toner particle shape, charging, fusing characteristics, gloss, stripping, offset properties and the like. Alternatively, a combination of waxes can be added to provide multiple properties to a sustainable toner composition. A wax may be included as, for example, a fuser roll release agent. The wax may also be combined with the sustainable polymer forming composition for forming sustainable toner particles. When included, the wax may be present in an amount of, for example, from about 1 weight % to about 25 weight % of the sustainable toner particles, or from about 5 weight % to about 20 weight % of the sustainable toner particles.

Waxes that may be selected for the sustainable toner compositions or sustainable toner particles include waxes having, for example, a weight average molecular weight of from about 500 to about 20,000, or from about 1,000 to about 10,000, or from about 2,000 to about 8,000. Waxes that may be used include, for example, polyolefins, such as, polyethylene, polypropylene and polybutene waxes, such as, those that are commercially available, for example, POLYWAX™ polyethylene waxes from Baker Petrolite; wax emulsions available from Michaelman, Inc. or Daniels Products Co.; EPOLENE N15™ which is commercially available from Eastman Chemical Products, Inc.; VISCOL 550P™, a low weight average molecular weight polypropylene available from Sanyo Kasei K.K.; plant-based waxes, such as carnauba wax, rice wax, candelilla wax, sumac wax and jojoba oil; animal-based waxes, such as beeswax; mineral-based waxes and petroleum-based waxes, such as montan wax, ozokerite, ceresin wax, paraffin wax, microcrystalline wax and Fischer-Tropsch waxes; ester waxes obtained from higher fatty acids and higher alcohols, such as stearyl stearate and behenyl behenate; ester waxes obtained from higher fatty acids and monovalent or multivalent lower alcohols, such as butyl stearate, propyl oleate, glyceride monostearate, glyceride distearate and pentaerythritol tetrabehenate; ester waxes obtained from higher fatty acids and multivalent alcohol multimers, such as diethyleneglycol monostearate, dipropyleneglycol distearate, diglyceryl distearate and triglyceryl tetrastearate; sorbitan higher fatty acid ester waxes, such as sorbitan monostearate; cholesterol higher fatty acid ester waxes, such as, cholesteryl stearate, and so on.

Examples of functionalized waxes that may be used include, for example, amines and amides, for example, AQUA SUPERSLIP 6550™ and SUPERSLIP 6530™ available from Micro Powder Inc.; fluorinated waxes, for example, POLYFLUO 190™, POLYFLUO 200™, POLYSILK 19™ and POLYSILK 14™ available from Micro Powder Inc.; mixed fluorinated amide waxes, for example, MICROSPERSION 19™ also available from Micro Powder Inc.; imides, esters, quaternary amines, carboxylic acids, acrylic polymer emulsions, for example, JONCRYL 74™, 89™, 130™, 537™ and 538™ available from SC Johnson Wax; and chlorinated polypropylenes and polyethylenes available from Allied Chemical, Petrolite Corp. and SC Johnson. Mixtures and combinations of the foregoing waxes also may be used in some embodiments.

Sustainable Toner Compositions—Charge Additives

The sustainable toner compositions may include any known charge additives in amounts of from about 0.1 to about 10 weight %, or from about 0.5 to about 7 weight % of the toner composition. Examples of such charge additives include alkyl pyridinium halides, bisulfates, the charge control additives of U.S. Pat. Nos. 3,944,493; 4,007,293; 4,079,014; 4,394,430; and 4,560,635, the disclosures of which are hereby incorporated by reference in their entireties, negative charge enhancing additives, such as, aluminum complexes, and the like. Charge enhancing molecules can be used to impart either a positive or a negative charge on a sustainable toner particle. Examples include quaternary ammonium compounds, see, for example, U.S. Pat. No. 4,298,672, the disclosure of which is hereby incorporated by reference in its entirety, organic sulfate and sulfonate compounds, see for example, U.S. Pat. No. 4,338,390, the disclosure of which is hereby incorporated by reference in its entirety, cetyl pyridinium tetrafluoroborates, distearyldimethyl ammonium methylsulfate, aluminum salts and so on.

Sustainable Toner Compositions—Characteristics

According to embodiments herein, the sustainable toner composition can have a hot offset temperature from about 190° C. to about 220° C., or from about 195° C. to about 215° C., or from about 200° C. to about 210° C.

In embodiments, the sustainable toner composition can have a cold offset temperature of from about 110° C. to about 120° C., or from about 112° C. to about 118° C., or from about 114° C. to about 116° C.

In embodiments, the sustainable toner composition can have a mottle temperature of from about 180° C. to about 200° C., or from about 185° C. to about 195° C., or from about 188° C. to about 192° C. In embodiments, the sustainable toner composition can have a blocking temperature of from about 52° C. to about 55° C., or from about 52° C. to about 54° C., or from about 53° C. to about 54° C.

In embodiments, the sustainable toner composition can exhibit a Tg of from about 30° C. to about 60° C., or from about 35° C. to about 55° C., or from about 40° C. to about 50° C.

In embodiments, the sustainable toner composition can exhibit a Ts of from about 90° C. to about 130° C., or from about 100° C. to about 120° C., or from about 105° C. to about 115° C.

In embodiments, the sustainable toner composition can exhibit an acid value (AV) from about 10 mg KOH/g to about 15 mg KOH/g, or from about 11 mg KOH/g to about 14 mg KOH/g, or from about 12 mg KOH/g to about 13 mg KOH/g.

In yet other embodiments, the sustainable toner composition can have a fusing latitude of from about 70 to about 100, or from about 75 to about 95, or from about 80 to about 90.

EXAMPLES

The following Examples illustrate exemplary embodiments of the present disclosure. These Examples are intended to be illustrative only to show one of several methods of preparing the sustainable toner compositions herein and are not intended to limit the scope of the present disclosure. Also, parts and percentages are by weight unless otherwise indicated.

A sustainable polymer derived from dehydroabietic acid (rosin), neopentylglycerine, terephthalic acid, succinic acid, propylene glycol and fumaric acid was prepared on the laboratory bench scale (2 liter) and on a pilot plant (PP) scale (20 gallon). Latexes from the sustainable polymer were made via the PIE process, and both the bench and PP batches were made into cyan toners.

Table 1 lists the fusing performance and blocking of the Bench Toners A and B, and the PP Toners A and B.

TABLE 1

| | Bench Toner A | Bench Toner B | PP Toner A | PP Toner B |
|---|---|---|---|---|
| Amorphous Resin | PP11346-SR1 | PP11349-SR3 | PP11346-SR2 | PP11349-SR3 |
| Latex Particle Size (nm) | 186.3 | 178.6 | 115 | 101 |
| Cold offset on CX+ | 120 | 113 | 117 | 117 |
| Gloss at MFT on CXS | — | — | 28 | 39 |
| Gloss at 185° C. on CXS | — | — | — | — |
| Peak Gloss on CXS | 60.6 | 57.5 | 54 | 57 |

TABLE 1-continued

| | Bench Toner A | Bench Toner B | PP Toner A | PP Toner B |
|---|---|---|---|---|
| T(Gloss 50) on CXS | 140 | 143 | 133 | 129 |
| T(Gloss 60) on CXS | — | — | — | — |
| $MFT_{CA-80}$ (extrapolated MFT) | 119 | 114 | 116 | 116 |
| ΔMFT (Relative to D-2240 toner) | −24 | −29 | −27 | −27 |
| Mottle/Hot Offset | 180/195 | 180/210 | 145/180 | 150/180 |
| Fusing Latitude Mottle − MFT/HO-MFT | 76 | 96 | 63 | 63 |

In the present disclosure, the term "CX+" refers to ColorXpressions+ (CX+) paper from Xerox Corporation. The term "CXS" refers to Color Xpressions Select (CXS) paper from XEROX Corporation. The term "D-2240" refers to DocuColor 2240 toner by Xerox Corporation.

As shown in Table 1, Bench Toners A and B having emulsion particle size of 186.3 nm and 178.6 nm, respectively, provided sustainable toners with high hot offset temperature and high blocking performance. By contrast, PP Toners A and B, having emulsion particle size of 115 nm and 101 nm, respectively, gave sustainable toners with lower hot offset and lower blocking temperature performance.

On analysis of the materials and processes, a main difference between the Bench Toners and PP Toners was the size of the latex particles and the processes used to form them. During the PIE process, the same solvent ratios and the same neutralization ratios were used, but the solvents were removed by distillation at about 80° C. to about 90° C. at atmospheric pressure and without a defoamer for the Bench Toners. By contrast, the solvents were removed by vacuum distillation at reduced temperature and pressure and in the presence of a defoamer for the PP Toners.

In another study, the same solvent ratio and neutralization ratio were utilized during the PIE process, but the solvents were removed by distillation at about 80° C. to about 90° C. at atmospheric pressure for the Bench Toners, whereas vacuum distillation at reduced temperature and pressure and in the presence of a defoamer was used for the PP Toners. The solvents used were MEK (methyl ethyl ketone) and isopropyl alcohol (IPA).

As shown in Table 2, the latex particles used in the PP Toners dramatically decreased in size by more than half after solvent removal.

TABLE 2

| | Bench Toner A | PP Toner A | PP Toner B |
|---|---|---|---|
| Solvent Ratio (Resin:MEK:IPA) | 10:8:1 | 10:8:1 | 10:8:1 |
| Neutralization Ratio | 86% | 85% | 85% |
| Defoamer | No | Yes | Yes |
| Particle Size Before Solvent Removal (nm) | 241 | 240 | 237 |
| Particle Size After Solvent Removal (nm) | 204 | 115 | 101 |

This surprising and unexpected result was not previously encountered with non-sustainable latex particles made by the PIE process.

To overcome the dramatic reduction in latex particle size during removal of the solvents, the temperature of distillation was reviewed both with and without defoamer. It was found that the defoamer had no influence on particle size reduction, but the distillation temperature did. Higher temperatures, for example, temperatures ranging from about 80° C. to about 90° C. at atmospheric pressure during distillation resulted in larger and more stable latex sizes after solvent removal. Furthermore, by increasing the neutralization ratio, for example, from about 80% to about 90%, or from about 85% to about 95%, or from about 90% to about 100%, greater than 200 nm latex particles could be obtained.

As shown in Table 3, distillation at higher temperatures, from about 80° C. to about 90° C., or from about 82° C. to about 88° C., or from about 84° C. to about 86° C., at atmospheric pressure and without the use of vacuum or a defoamer, provided latex particles on the bench and PP scale without significant reduction in particle size.

TABLE 3

| | Before Evaporation | After Evaporation |
|---|---|---|
| Bench Scale (2 Liter) | 274 nm | 277 nm |
| PP Scale (5 gallon) Trial 1 | 270 nm | 216 nm |
| PP Scale (5 gallon) Trial 2 | 265 nm | 239 nm |

Example 1

Sustainable Toner Made with the Bio Based Carbonate Route

Into a 2 liter glass reactor equipped with an overhead mixer was added 286.41 g emulsion (latex particle size 100.1 nm) of bio based polymer (21.72 wt %) prepared by standard PIE process, 23.91 g crystalline polymer emulsion (35.60 wt %), 37.67 g IGI wax dispersion (30.05 wt %) and 47.15 g cyan pigment PB15:3 (15.6 wt %). Separately, 2.20 g $Al_2(SO_4)_3$ (27.85 wt %) was added in as the flocculent under homogenization. The mixture was heated to 46.9° C. to aggregate the particles while stirring at rpm 300 rpm. The particle size was monitored with a COULTER COUNTER™ until the core particles reached a volume average particle size of 4.63 μm with a GSD volume of 1.24, and then 158.18 g of the above mentioned bio based polymer emulsion was added as shell material, resulting in core-shell structured particles with an average particle size of 5.42 microns, GSD volume 1.24. Thereafter, the pH of the reaction slurry was increased to 8 using 4 wt % NaOH solution followed by 4.72 g EDTA (39 wt %) to freeze the toner growth. After freezing, the reaction mixture was heated to 75° C., while maintaining the pH between 7.8 and 8. Then, the pH was increased to 9.05 followed by reducing pH to 8.1 when approaching 3 hours of coalescence. The toner was quenched after coalescence, resulting in a final particle size of 5.83 microns, GSD volume of 1.25, GSD number 1.29, and circularity 0.955. The toner slurry was then cooled to room temperature, separated by sieving (25 mm), filtration, followed by washing and freeze drying.

Example 2 and Example 3 were made with the same bio based sustainable polymer and the same procedure as in Example 1, i.e. the same solvent ratios and neutralization ratios, except that the latexes in Example 1 had a particle size of 100.1 nm; while the latexes in Example 2 had a particle size of 143.8 nm; and the latexes in Example 3 had a particle size of 241.0 nm.

Table 4 shows the hot offset fusing and blocking temperature results for the above sustainable toners of Examples 1-3.

TABLE 4

| | Example 1 | Example 2 | Example 3 |
|---|---|---|---|
| Amorphous Resin | PP11346-SR2 | PP11346-SR2 | PP11346-SR2 |
| Emulsion Latex Particle Size (nm) | 100.1 | 143.8 | 241.0 |
| Cold offset on CX+ | 113 | 123 | 120 |
| Gloss at MFT on CXS | 26.0 | 34.3 | 32.4 |
| Gloss at 185° C. on CXS | 47.8 | / | 54.9 |
| Peak Gloss on CXS | 57.3 | 61.4 | 62.4 |
| T(Gloss 50) on CXS | 141 | 134 | 138 |
| T(Gloss 60) on CXS | / | 146 | 153 |
| $MFT_{CA-80}$ (extrapolated MFT) | 116 | 121 | 121 |
| Δ MFT (Relative to D-2240 fused the same day) | −21 | −18 | −21 |
| Mottle/Hot Offset CXS at 220 mm/s | 180/210 | 147/180 | 190/210 |
| Fusing Latitude Mottle − MFT/HO-MFT on DCS | 64/94 | 24/57 | 69/89 |
| Δ Fix ($T_{G50}$ & $MFT_{CA-80}$) | −20 | −29/−11 | −28/−10 |
| Blocking Temperature | 50 | 52 | 54 |

As shown in Table 4 for Examples 1-3, blocking temperature increases (from 50° C. to 54° C.) with increasing emulsion latex particle size (from 100.1 nm to 241.0 nm). On the other hand, the fusing results of each sustainable toner are not repeatable and, Example 3, having the largest latex particle size of 241.0 nm, gave the best overall performance based on mottle temperature, hot offset temperature and blocking temperature.

Table 5 summarizes PP Toners (Toner ID C-G) made with sustainable polymer with 9% IGI wax and 6.8% CPE.

TABLE 5

| | Toner ID | | | | |
|---|---|---|---|---|---|
| | C | D | E | F | G |
| Latex Particle Size (nm) | 110.1 | 110.1 | 208.2 | 270 | 270 |
| Temp. Coalescence (° C.) | 73 | 80 | 76.5 | 73 | 80 |
| AI/EDTA | 0.3 pph/1.5 pph | 0.3 pph/1.5 pph | 0.3 pph/1.5 pph | 0.3 pph/1.5 pph | 0.3 pph/1.5 pph |
| D50 (μm) | 5.20 | 5.96 | 5.90 | 5.65 | — |
| GSD | 1.24/1.27 | 1.24/1.27 | 1.24/1.27 | 1.24/1.27 | 1.24/1.27 |
| Circ. | 0.963 | 0.967 | 0.966 | 0.965 | — |

In Table 6, the fusing and blocking results for the PP Toners listed in Table 5 are provided:

TABLE 6

| | Toner ID | | | | |
|---|---|---|---|---|---|
| | C | D | E | F | G |
| Latex Particle Size (nm) | 100 | 100 | 205 | 270 | 270 |
| Temp. Coalescence (° C.) | 73 | 80 | 76.5 | 73 | 80 |
| Cold Offset (° C.) | 117 | 117 | 117 | 113 | 113 |
| Gloss Mottle (° C.) | 137 | 155 | 137 | 195 | 140 |
| Severe Mottle (° C.) | 160 | 170 | 170 | | 160 |

TABLE 6-continued

| | Toner ID | | | | |
|---|---|---|---|---|---|
| | C | D | E | F | G |
| Hot Offset (° C.) | 180 | 195 | 190 | >210 | 165 |
| Blocking Temperature (° C.) | 50 | 52.5 | 52 | 51.5 | 50 |

The improved fusing properties and hot offset performance of another sustainable toner made from sustainable polymer and having latex particle size of 225.5 nm is demonstrated in Table 7.

TABLE 7

| | PP Toner |
|---|---|
| Amorphous Resin | PP-SR4 |
| Emulsion Latex Particle Size (nm) | 225.5 |
| Cold offset on CX+ | 123 |
| Gloss at MFT on CXS | 35 |
| Gloss at 185° C. on CXS | — |
| Peak Gloss on CXS | 57 |
| T(Gloss 50) on CXS | 148 |
| T(Gloss 60) on CXS | 165 |
| $MFT_{C4-80}$ (extrapolated MFT) | 123 |
| Δ MFT (Relative to D-2240 toner fused the same day) | −20 |
| Mottle/Hot Offset | 190/210 |
| Fusing Latitude | 87 |
| Mottle − MFT/HO-MFT on DCS | |

The results listed in Tables 1 to 7 illustrate that in order to obtain overall good charging, fusing and blocking properties, the latex particle size for a sustainable polymer is from about 180 nm to about 250 nm, or from about 190 nm to about 240 nm, or from about 200 nm to about 230 nm, or from about 210 nm to about 220 nm.

It will be appreciated that variations of the above-disclosed and other features and functions, or alternatives thereof, may be desirably combined into many other different systems or applications. Also that various, presently unforeseen or unanticipated, alternatives, modifications, variations or improvements therein may be subsequently made by those skilled in the art which are also intended to be encompassed by the following claims.

What is claimed is:

1. A method of preparing a sustainable toner composition, comprising:

preparing an emulsification mixture of a sustainable polymer having an acidic group in a solvent;

wherein the solvent is a mixture of methyl ethyl ketone and isopropanol, forming latex particles;

neutralizing the emulsification mixture with a base at a neutralization ratio of from about 80% to about 90%;

removing the solvent, used in the emulsification mixture, from the latex particles by distillation at a temperature of from about 80° C. to about 90° C. forming toner particles;

aggregating the toner particles to form aggregated toner particles; and coalescing the aggregated toner particles to produce the sustainable toner composition.

2. The method of claim 1, wherein the solvent used in the emulsification mixture is removed from the latex particles by distillation at a temperature of from about 82° C. to about 88° C.

3. The method of claim 1, further comprising the step of adjusting the toner particles to an average size of from about 180 nm to about 250 nm.

4. The method of claim 1, wherein the distillation occurs at about 760 mm Hg.

5. The method of claim 1, wherein methyl ethyl ketone and isopropanol are present in a solvent ratio from about 20 to about 1.

* * * * *